United States Patent [19]

Kageyama et al.

[11] Patent Number: 4,969,763

[45] Date of Patent: Nov. 13, 1990

[54] LEAD FORWARDING MECHANISM RETAINER FOR THURST ACTION MECHANICAL PENCIL

[75] Inventors: Shuhei Kageyama; Tadayoshi Ebinuma; Yoshihide Mitsuya, all of Kawagoeshi, Japan

[73] Assignee: Kotobuki & Co., Ltd., Japan

[21] Appl. No.: 194,784

[22] Filed: May 17, 1988

[30] Foreign Application Priority Data

May 18, 1987 [JP] Japan ..... 62-74531[U]

[51] Int. Cl.[5] ..... A45D 40/04; B43K 21/08

[52] U.S. Cl. ..... 401/68; 401/65

[58] Field of Search ..... 401/49, 53, 58, 62, 401/65, 73, 83, 84, 86, 99, 104–106, 109, 112

[56] References Cited

U.S. PATENT DOCUMENTS 2,883,967 4/1959 Tessier ..... 401/86
3,623,821 11/1971 Gould ..... 401/86
4,806,038 2/1989 Jones ..... 401/65 X

FOREIGN PATENT DOCUMENTS 59-87984 6/1984 Japan .
1002875 9/1965 United Kingdom ..... 401/112

*Primary Examiner*—Richard J. Apley
*Assistant Examiner*—D. F. Crosby
*Attorney, Agent, or Firm*—Donald D. Mon; David O'Reilly

[57] ABSTRACT

A thrust-action mechanical pencil having a lead-forwarding mechanism and an outer sleeve, the lead-forwarding mechanism being inserted from the rear end of the outer sleeve. An elastic member to prevent looseness is inserted between a chuck ring sleeve, and an inner ring provided on the inside of the outer sleeve to prevent forward movement. A tubular retaining sleeve having a full length slit is installed between a mouth piece and a stepped portion of the lead forewarding mechanism. A retaining portion on the forward end of the retaining sleeve is set between the mouth piece and the forward end of the outer sleeve to retain the lead-forwarding mechanism in the pencil.

12 Claims, 4 Drawing Sheets

LEAD FORWARDING MECHANISM RETAINER FOR THURST ACTION MECHANICAL PENCIL

FIELD OF THE INVENTION

This invention relates to mechanical pencils which feed lead by a thrust action and more particularly to an improved construction for attaching the lead-forwarding mechanism in the pencil.

BACKGROUND OF THE INVENTION

This invention relates to a thrust-action mechanical pencil in which a lead-forwarding mechanism is attached to an outer sleeve by an inner ring to prevent forward movement, and has an elastic retaining member to prevent looseness used to retract the lead-forwarding mechanism to said inner ring and a retaining sleeve to prevent rear movement of a mouth piece.

Such thrust-action mechanical pencils are commonly known, as for example, the pencil described in Japanese Utility Model publication No. 87984/59 (1984).

In this common example, an inner sleeve acting as a lead-forwarding mechanism is inserted in an outer sleeve with the inner sleeve being pressed rearward by a retaining ring set in a small groove engraved around the circumferential end of a mouth piece on the inner sleeve and an elastic member on the connecting part of the inner sleeve that presses against a receiving part for the elastic member.

The above example solves the usual problem of threaded mouth piece-typed pencils, becoming loose in use and breaking the lead and also causing the loss of the mouth piece which sometimes slips out, by attaching the lead-forwarding mechanism to the outer sleeve with a retaining ring and elastic member.

However, a problem with the above example is that it cannot be assembled in one motion. This is because separate actions are required to maintain the inner sleeve forced rearward and to insert the retaining ring by means of jig. Also because the lead-forwarding mechanism is attached to the outer sleeve by engaging the retaining ring with the small groove engraved around the circumferencial end of the mouth piece, looseness between the small groove and the retaining ring cannot be not compensated for without increasing the working accuracy of both the small groove and the retaining ring. Further there is a possibility that the retaining ring can slip out of the small groove due to the elasticity of the elastic member and jig is necessary to the set retaining ring.

BRIEF DESCRIPTION OF THE INVENTION

The purpose of this invention is to provide a thrust-action pencil in which breaking lead and loss of the mouth piece due to loosening are prevented. Attachment of the lead-forwarding mechanism to the outer sleeve can be easily, positively done without looseness and without using a jig or increasing work accuracy. The construction is simple and can be cheaply made.

A thrust-action mechanical pencil according to the invention as shown in the drawings is characterized by lead-forwarding mechanism 2 inserted from the rear end of outer sleeve 1, having an elastic member 5, to prevent looseness, inserted between chuck ring sleeve 3, and constitutes the lead-forwarding inner ring 4 provided on the inside of outer sleeve 1, to prevent forward movement. Retaining sleeve 10 having slit 9 extending over the full length is inserted between mouth part 7 and radially outward projecting step-shaped part 8. Forward member 6 is connected to chuck ring sleeve 3 with retaining portion 11 or ridge on the forward end of retaining sleeve 10, set between mouth part 7 and the forward end of outer sleeve 1.

Lead-forwarding mechanism 2 is thrust from the rear end (not shown) of outer sleeve 1 against the force of elastic member 5, inserted between chuck ring sleeve 3 and inner ring 4 to prevent looseness. Prevention of forward movement is provided on the inside of outer sleeve 1 by the rear end of retaining sleeve 10, inserted between mouth part 7 and radially outward projecting step-shaped part 8 of forward member 6 connected to chuck ring sleeve 3, being pushed by the radially outward projecting step-shaped part 8. when retaining portion 11 on retaining sleeve 10 extends from outer sleeve 1, the thrusting operation is stopped. Then, by slightly pulling backward on lead container 13, retaining part 11 is set between the rear of mouth piece 7 on forward member 6 and outer sleeve 1, securing lead-forwarding mechanism 2 in outer sleeve 1.

The above and other features of this invention will be fully understood from the following detailed description and the accompanying drawings, in which:

DETAILED DESCRIPTION OF THE INVENTION

Figure 1:
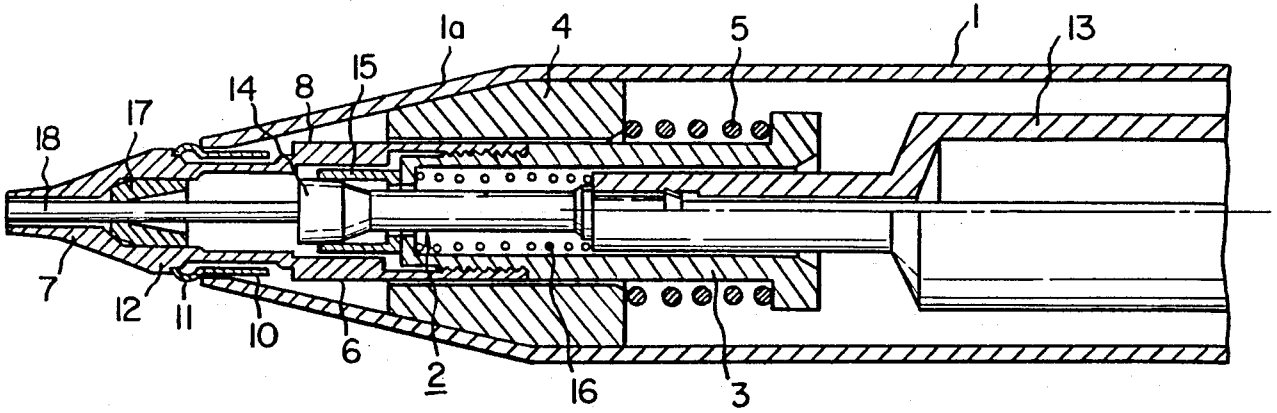
FIG. 1 is a cross-sectional view of the essential operating parts of a typical thrust-action mechanical pencil according to this invention.
Figure 2:
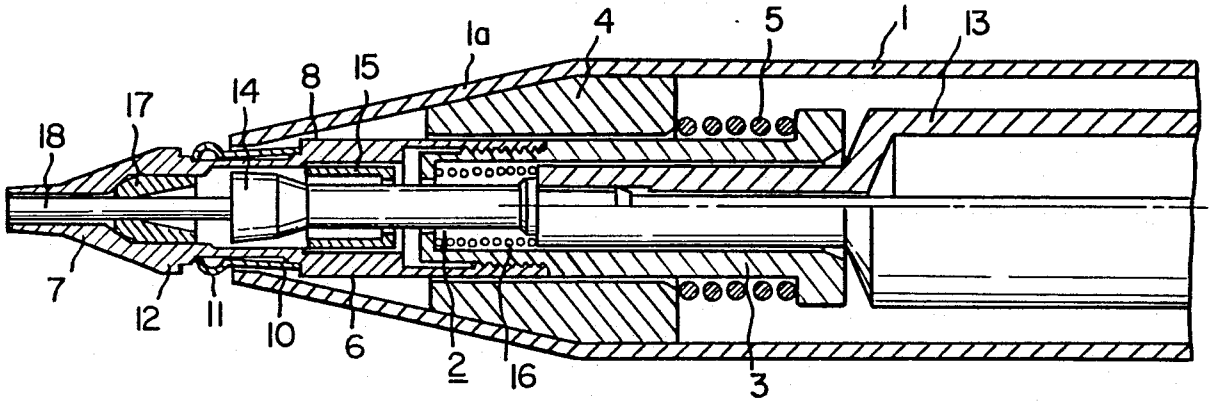
FIG. 2 is a cross-sectional view of the essential operating parts of the embodiment of FIG. 1 showing the condition of securing a lead-forwarding mechanism to the outer sleeve.
Figure 3A:
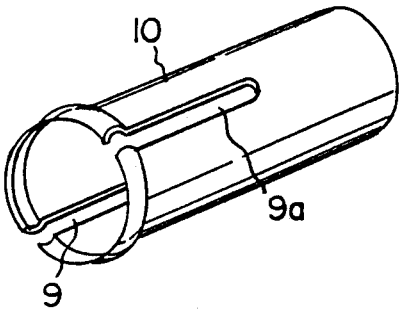
FIGS. 3*a* and 3*b* are respectively, perspective views illustrating a retaining sleeve used in this embodiment and a perspective view of the retaining sleeve prior to being formed.
Figure 3B:
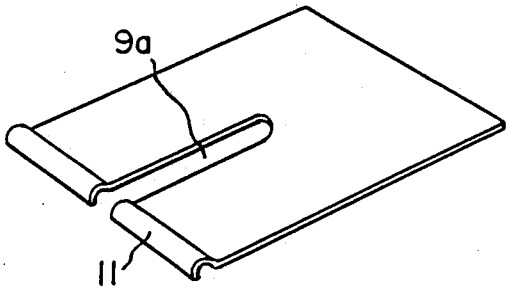

Referring to the drawings, FIG. 1 is a cross-sectional view of the operating parts of one embodiment of a thrust-action mechanical pencil according to this invention. FIG. 2 is a cross-sectional view of the embodiment of FIG. 1 showing how the lead-forwarding mechanism is installed and set. FIGS. 3*a* and 3*b* are perspective views showing the retaining sleeve used in this embodiment, and a perspective view showing the retaining sleeve before it is formed, respectively.

In FIG. 1, outer sleeve 1 has a forward part 1*a* and lead-forwarding mechanism 2 inserted from the rear end of outer sleeve 1.

Lead-forwarding mechanism 2 is comprised of lead container 13, chuck 14, chuck ring 15, and chuck ring sleeve 3 in contact with the rear end of chuck ring 15. Also included are chuck spring 16 between chuck ring sleeve 3 and forward end of lead container 13. Forward member 6 is connected to chuck ring sleeve 3 by means of threads and the like, and has mouth piece 7. Rubber packing supporting part 17 for lead 18 is provided inside mouth piece 7.

An elastic member or spring 5 to prevent looseness, is inserted between chuck ring sleeve 3 of lead-forwarding mechanism 2 and inner ring 4 to prevent forward movement. Inner ring 4 is secured on the inside of the forward end portion of outer sleeve 1 or is integrally formed. Retaining sleeve 10, (see FIG. 3*a*), having a full length slit 9 is set between the rear of mouth piece 7 and radially outward projecting step-shaped portion 8 of forward member 6.

In this embodiment retaining sleeve 10 may also have a suitable number of slits 9*a* extending only approximately halfway.

Retaining portion 11 on the forward end portion of retaining sleeve 10 is inserted between shoulder portion 12 of mouth piece 7 on member 6 and the forward end portion of outer sleeve 1.

Figure 4A:
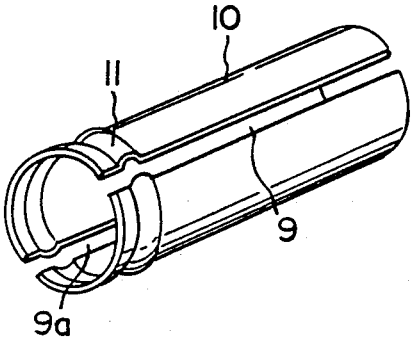
FIGS. 4*a* and 4*b*, 5*a* and 5*b* are respectively perspective views of optional retaining sleeves after and before being formed.
Figure 5A:
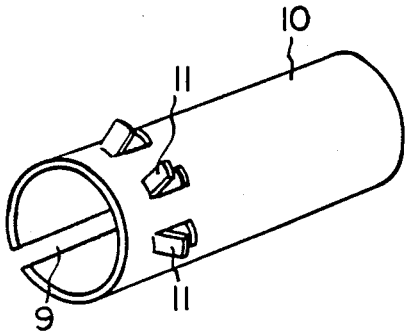
Figure 6A:
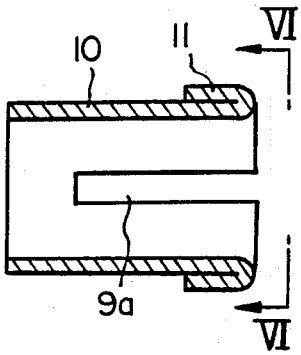
FIGS. 6*a* and 6*b* are respectively a cross-sectional view and a perspective view taken along line VI—VI of FIG. 6*a*, of another optional retaining sleeve.
Figure 6B:
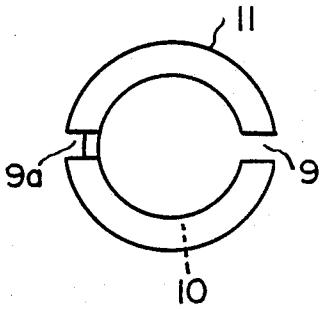
Figure 7A:
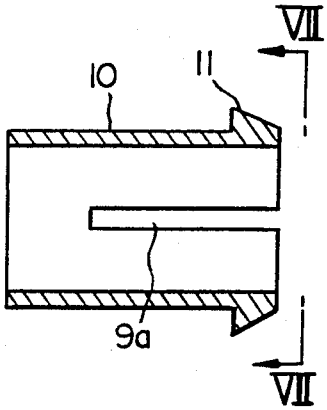
FIGS. 7*a* and 7*b* respectively are a cross-sectional view and a perspective view taken along line VII—VII of FIG. 1*a*, of still another optional retaining sleeve.
Figure 7B:
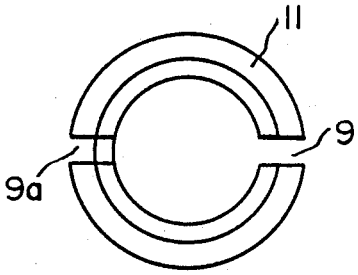

Retaining portion 11 of retaining sleeve 10 is a ridge that projects out from the forward end of retaining sleeve 10 in the form of an arc, (see FIGS. 1 to 3). Retaining portion 11 may be displaced a short distance from the forward end of retaining sleeve 10 and projects out in the manner shown in the optional design of FIG. 4*a*, or may be formed by providing raised flaps 11 in the forward end portion of retaining sleeve 10 as shown in the optional design of FIG. 5. Retainer portion 11 may also be formed by a folded over forward end portion 11 of retaining sleeve 10 shown in FIG. 6*a* or may be formed by providing a hook-shaped projection portion or ridge on the forward end portion of retaining sleeves 10 as shown in FIG. 7*a*.

Figure 4B:
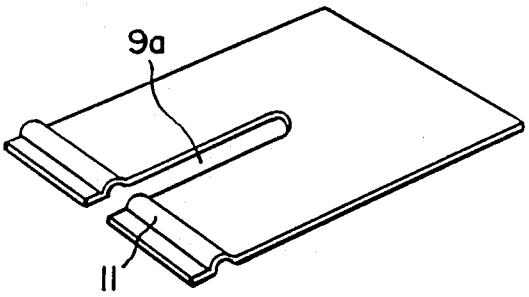
Figure 5B:
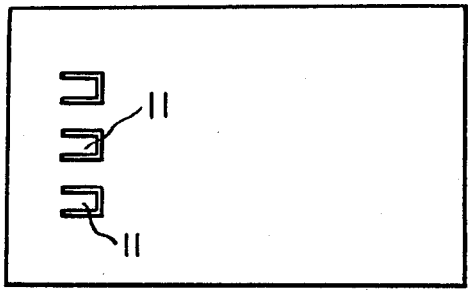

Retaining sleeve 10 can be formed by rolling a plate-shaped body as shown in FIGS. 3*b*, 4*b*, and 5*b*, having retaining portions 11 into a tubular body. Retaining sleeve 10 is thus a tubular body having slits 9, 9*a* and a retaining portion 11.

The embodiment of the above construction is used to secure lead-forwarding mechanism 2 in outer sleeve 1, by thrusting lead-forwarding mechanism 2 forward from the rear end of outer sleeve (not shown) against the force of spring 5, inserted between chuck ring sleeve 3 and inner ring 4 to prevent looseness. Inside of outer sleeve 1 inner ring 4 prevents forward movement so that the rear end of retaining sleeve 10, inserted behind the rear of mouth piece 7, is pushed forward by radially outward projecting step-shaped part 8 through end 1*a* of outer sleeve 1 shown in FIG. 2. When retaining portion 11 on retaining sleeve 10 extends out of the forward end of outer sleeve 1, the pushing operation is stopped. Then, by a slightly backward pull on lead container 13, retaining portion 11 is set between shoulder portion 12 of mouth piece 7 and the forward end of outer sleeve 1 securing lead-forwarding mechanism 2 in outer sleeve 1.

Lead-forwarding mechanism 2 and 5 can be removed by bending or squeezing inward retaining portion 11 of retaining sleeve 10 to allow it to pass through the forward end of outer sleeve 1 (FIG. 2).

According to this embodiment, lead-forwarding mechanism 2 can be secured in outer sleeve 1 easily by pushing and releasing chuck ring sleeve 3 against loosening prevention spring 5 with retaining sleeve 10 having slit extending over its full length between the rear of mouth piece 7 and radially outward projecting step-shaped part 8 and having retaining portion 11 set between shoulder part 12 of mouth piece 7 and the end of outer sleeve 1. Therefore, the installation of lead-forwarding mechanism 2 can be done by the simple action of pushing and releasing the lead-forwarding mechanism. Looseness is prevented by inserting retaining portion 11 of retaining sleeve 10 between shoulder portion 12 of mouth piece 7 and the end of outer sleeve 1. There is no possibility that the lead-forwarding mechanism can slip out of outer sleeve 1.

Further, because retaining sleeve 10 is installed behind mouth piece 7 side by utilizing full length slit 9 before lead-forward mechanism 1 is installed in outer sleeve 1, a jig is not necessary. In addition, this arrangement prevents breaking lead 18 and the loss of a separate mouth piece due to loosening.

Figure 8:
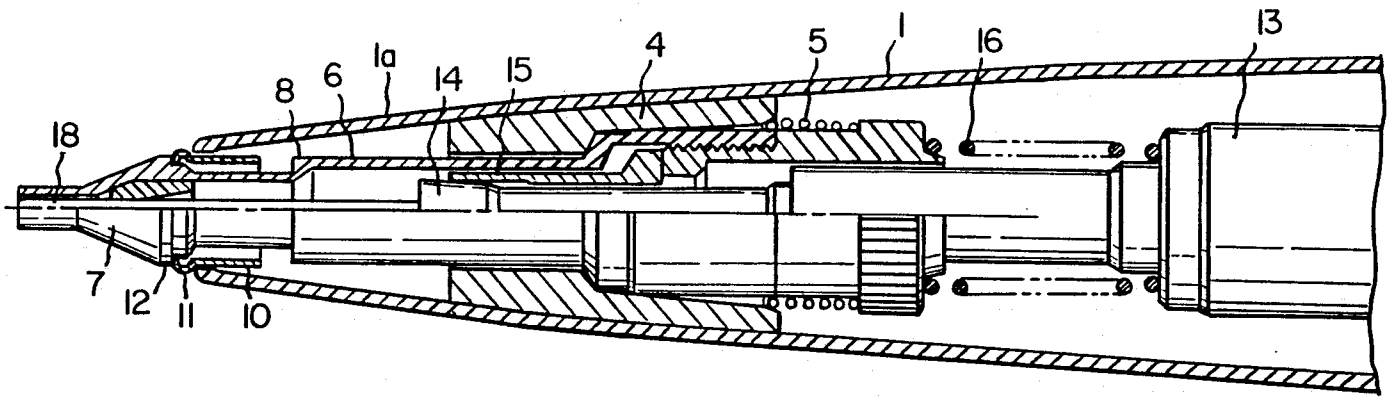
FIG. 8 is a cross-sectional view of the essential operating parts of another embodiment.
Figure 10:
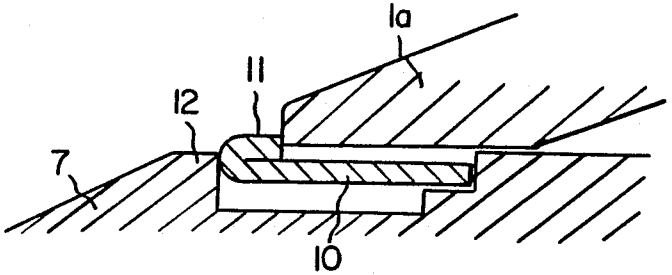
FIG. 10 is a partial sectional view illustrating the use of the sleeve of FIG. 5.
Figure 9:
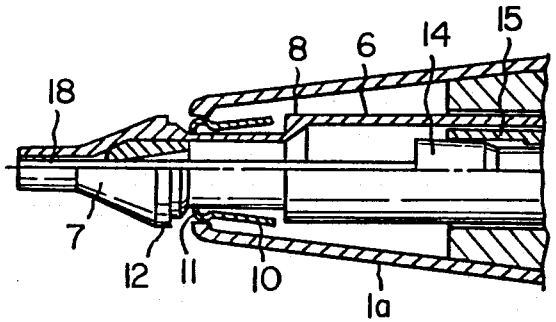
FIG. 9 is a cross-sectional view of the essential operating parts of the embodiment of FIG. 8 showing the lead-forwarding mechanism secured to the outer sleeve.

FIG. 8 is a cross-sectional view of the essential operating parts of another embodiment while FIG. 9 is a cross-sectional view of the embodiment shown in FIG. 8 showing a lead-forwarding mechanism secured in the outer sleeve.

In this embodiment, retaining sleeve 10 is set between mouth piece 7 and radially outward projecting step-shaped part 8 as before. However, in this embodiment, bending of retaining sleeve 10 can be more easily done, because the entire retaining sleeve can bend outward as shown in FIG. 9.

However, in the example shown in FIG. 1, bending of the retaining sleeve 10 is less easy than the embodiment shown in FIG. 8, as retaining sleeve 10 bends from the rear end of the retaining sleeve as the supporting point in FIG. 2.

Thus according to this invention, it is possible to easily install a lead-forwarding mechanism in outer sleeve 1 with one action. In addition, a jig is not necessary to attach retaining sleeve 10 and there is no possibility that the lead-forwarding mechanism can slip out of the outer sleeve.

This invention is not to be limited by the embodiments shown in the drawings and described in the description, which are given by way of example and not of limitations, but only in accordance with the scope of the appended claims.

We claim:

1. A thrust-action mechanical pencil having a lead forwarding mechanism inserted in an outer sleeve characterized by a chuck ring sleeve (3) on said lead forwarding mechanism (2); an inner retaining part (4) secured to an inside forward portion of said outer sleeve (1); an elastic member (5) positioned between said inner retaining part (4) and said chuck ring sleeve (3); said elastic member constructed and positioned to restrain said chuck ring sleeve (3); a mouth piece (7) attached to a forward end of said chuck ring sleeve (3); said moutn piece (7) extending from a forward end of said chuck ring sleeve (3) out of said outer sleeve (1); a radially compressible sleeve (10) mounted, around said mouth piece (7) between a shoulder (12) on a forward end of said mouth piece (7) and a radially projecting step (8) on a rearward portion of said mouth piece (7) and a radially projecting step (8) on a rearward portion of said mouth piece (7); said radially compressible retaining sleeve (10) having a raised retaining portion (11), said raised portion being set between said shoulder (12) on said mouth piece (7) and the forward end of said outer sleeve (1).

2. The thrust-action mechanical pencil according to claim 1 in which said retaining sleeve (10) is in a rolled tubular shape having a full length slit allowing said retaining sleeve to compress radially.

3. The thrust-action mechanical pencil according to claim 2 in which said retaining sleeve (10) has a partial slit (9*a*) opposite said full length slit (9).

4. The thrust-action mechanical pencil according to claim 3 in which said raised retaining portion (11) of said retaining sleeve (10) is an outward projecting ridge.

5. A thrust-action mechanical pencil according to claim 1 in which said raised retaining portion (11) of said retaining sleeve (10) is an outward projecting ridge.

6. The thrust-action mechanical pencil according to claim 1 in which said radially compressible retaining sleeve (10) has a pair of slits (9*a*) on opposite sides extending approximately half the length of the sleeve, allowing said retaining sleeve to compress radially.

7. A thrust-action mechanical pencil having a lead forwarding mechanism (2) inserted and retained in an outer sleeve (1) from the rear comprising; a chuck ring sleeve (3) on said lead forwarding mechanism (2); an inner support member (4) in a bowed end said outer sleeve; an elastic member between said chuck ring sleeve (3) and said inner support member (4) for firmly retaining a lead forwarding member (14); a mouth piece (7) formed on a forward member (6) attached to said chuck ring sleeve (3); a compressible tubular retaining sleeve (10) mounted on said forward member (6) behind said mouth piece (7) and forward of a stepped portion (8) of said forward member (6); said tubular retaining sleeve (10) having a retaining projection (11), said retaining projection (11) being set between the forward end of said outer sleeve and said mouth piece (7) thereby locking and securing said lead-forwarding mechanism (2) in said pencil.

8. A thrust-action mechanical pencil according to claim 6 in which said retaining sleeve (10) is in a rolled tubular shape having a full length slit allowing said retaining sleeve (10) to compress radially.

9. A thrust-action mechanical pencil according to claim 7 in which said retaining sleeve (10) has a partial slit (9*a*) opposite said full length slit (9).

10. A thrust-action mechanical pencil according to claim 9 in which said retaining projection (11) of said retaining sleeve (10) is an outward projecting ridge.

11. A thrust-action mechanical pencil according to claim 7 in which said raised retaining projection (11) of said retaining sleeve (10) is an outward projecting ridge.

12. A thrust-action mechanical pencil according to claim 7 in which said retaining sleeve (10) has a pair of slits on opposite sides extending approximately half the length of the sleeve allowing said retaining sleeve (10) to compress radially.

* * * * *